US005768758A

United States Patent [19]

Deignan et al.

[11] Patent Number: 5,768,758

[45] Date of Patent: Jun. 23, 1998

[54] METHOD AND APPARATUS FOR ATTACHMENT OF UPHOLSTERY TO SEATS

[75] Inventors: Chris Deignan, West Kingston; Thomas M. Miller, Barrington, both of R.I.; G. Michael Hanahan, Bloomfield Heights, Mich.; Abraham Silberberg, Providence, R.I.

[73] Assignee: NFA Corp., Hope Webbing Division, Providence, R.I.

[21] Appl. No.: 720,222

[22] Filed: Sep. 26, 1996

Related U.S. Application Data

[60] Continuation of Ser. No. 300,448, Sep. 2, 1994, abandoned, which is a division of Ser. No. 60,605, May 12, 1993, abandoned.

[51] Int. Cl.[6] ..... B68G 7/00; A47C 31/00

[52] U.S. Cl. ..... 29/91.1; 29/91.5; 297/218.3; 297/218.4; 297/228.11

[58] Field of Search ..... 29/91, 91.1, 91.5, 29/243.57; 297/218.1, 218.2, 218.3, 218.4, 218.5, 219.1, 224, 226, 228.1, 228.11, 228.12, 452.62, 452.64, 452.58; 66/190, 192, 193, 195, 196; 428/83, 123, 225, 193

[56] References Cited

U.S. PATENT DOCUMENTS

| | | | |
|---|---|---|---|
| Re. 33,586 | 5/1991 | Graff . | |
| 570,221 | 10/1896 | Haubner | 428/225 |
| 1,304,753 | 5/1919 | Dwyer | 297/228.11 |
| 1,544,141 | 6/1925 | Eddins | 297/228.11 |
| 1,711,624 | 5/1929 | Vorck et al. | 66/192 |
| 1,768,454 | 6/1930 | King | 297/228.11 |
| 1,962,215 | 6/1934 | Sallop . | |
| 2,161,448 | 7/1939 | Bishop . | |
| 2,191,848 | 2/1940 | Cramer et al. | 297/228.11 |
| 2,212,485 | 8/1940 | Krasnov . | |
| 2,644,510 | 7/1953 | Benmax . | |
| 3,233,253 | 2/1966 | Cauvin . | |
| 3,424,220 | 1/1969 | Schuerch | 66/192 |
| 3,630,572 | 12/1971 | Holmer . | |
| 3,653,712 | 4/1972 | Sarvas . | |
| 4,590,715 | 5/1986 | Pandell | 428/83 |
| 4,632,863 | 12/1986 | Henningsson | 428/225 |
| 4,676,549 | 6/1987 | English . | |
| 4,693,511 | 9/1987 | Seltzer et al. . | |
| 4,732,097 | 3/1988 | Guilhem . | |
| 4,834,451 | 5/1989 | Meunier et al. . | |
| 4,865,383 | 9/1989 | Sbaragli et al. . | |
| 4,872,724 | 10/1989 | Deley et al. . | |
| 5,150,947 | 9/1992 | Croshaw . | |
| 5,338,092 | 8/1994 | Wiltsey et al. . | |
| 5,457,968 | 10/1995 | McClintock et al. | 297/284 |
| 5,529,373 | 6/1996 | Olson et al. | 297/218.4 |
| 5,560,677 | 10/1996 | Cykana et al. | 297/218.3 |
| 5,628,545 | 5/1997 | Perthuis et al. . | |

FOREIGN PATENT DOCUMENTS

| | | | |
|---|---|---|---|
| 660468 | 4/1963 | Canada . | |
| 2153069 | 2/1979 | Germany . | |
| 539807 | 7/1956 | Italy | 297/218.4 |

*Primary Examiner*—David P. Bryant
*Attorney, Agent, or Firm*—Wolf, Greenfield & Sacks, P.C.

[57] ABSTRACT

A method and apparatus for securing upholstery or some other fabric to a seat having a frame, such as an automobile seat. The apparatus includes an elongated web of material having a cord incorporated therein which extends in the direction of elongation of the web. The cord may be extracted at various points along the length of the web. Hooks are provided on the seat, typically on the underside thereof, to which the web is attached. The web may be either elastic or nonelastic, and the cord may be either elastic or nonelastic. Non-elastic cord is used, an extra length of cord may be incorporated into the web. The web may be knitted, woven or braided. In the method of this invention, a web with an incorporated cord is secured to an edge of the upholstery which is desired to be secured to a seat. The cord is extracted from the web at preselected points and attached to a fastening device. The length of cord provided in the web is sufficient to allow fastening, but also still holds the upholstery tightly in place.

7 Claims, 9 Drawing Sheets

FIG. 1
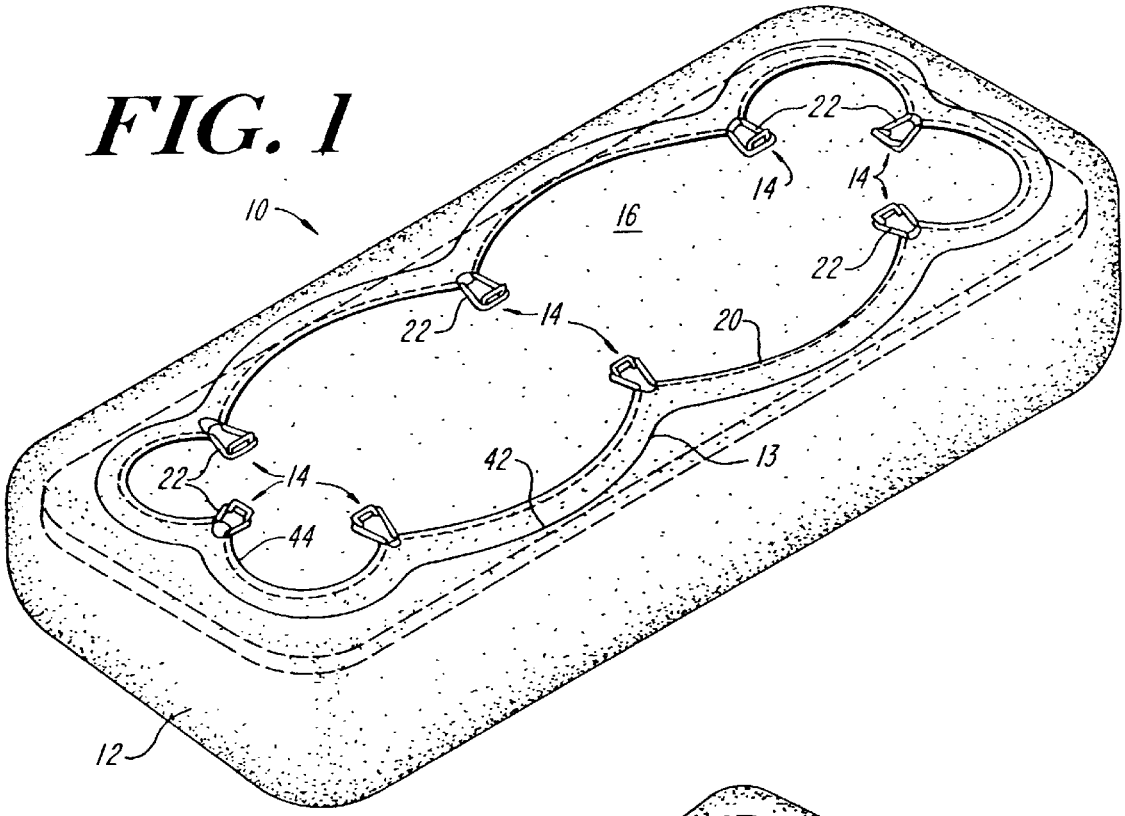
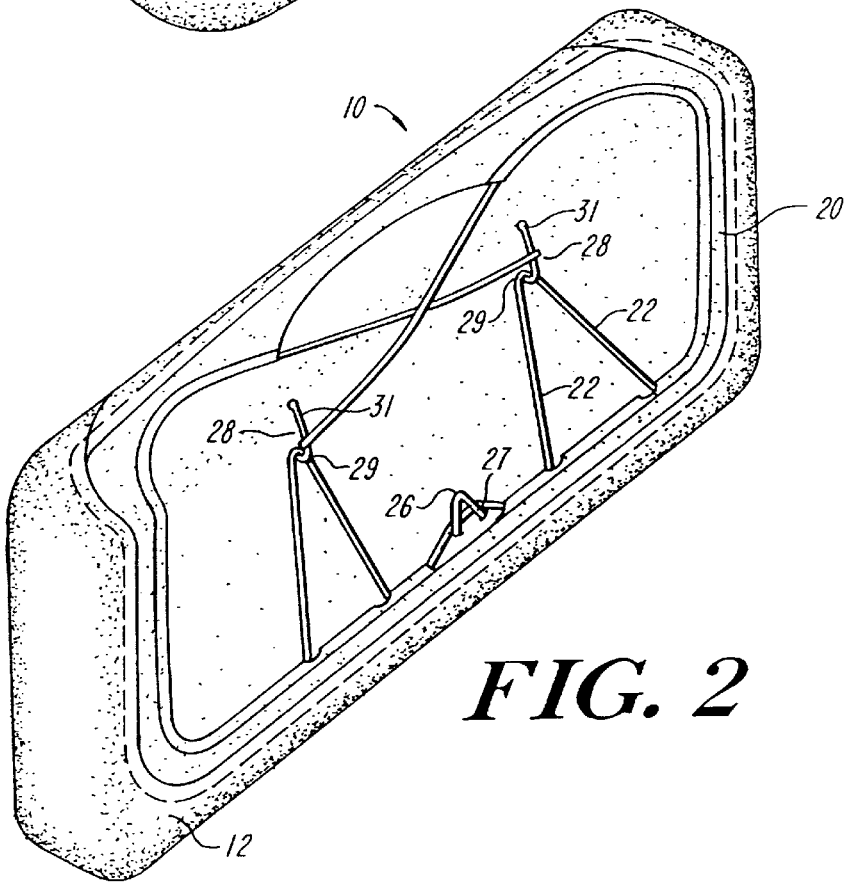
FIG. 2

METHOD AND APPARATUS FOR ATTACHMENT OF UPHOLSTERY TO SEATS

This application is a continuation, of application Ser. No. 08/300,448, filed Sep. 2, 1994, now abandoned, which is a division of application Ser. No. 08/060,605 filed May 12, 1993, now abandoned.

FIELD OF THE INVENTION

This invention relates generally to automobile seats, chairs and like furniture, and more particularly, to a web with an incorporated cord for attachment of upholstery.

BACKGROUND OF THE INVENTION

In the assembly of seats, such as automobile seats, chairs, couches and the like, it is often necessary to secure a fabric covering, i.e. upholstery, over a basic frame structure formed of metal, wood, or other like materials. The frame often includes springs and/or foam cushions and the like. Typically, the fabric covering has a beaded edge comprised of a paper or cardboard cord wrapped in fabric. With respect to automobile seats, typically secured to the edge of the upholstery is a strip of non-woven material or a strip of plastic closing a paper or plastic cord for reinforcement of the edge of the upholstery. In the assembly of automobile seats, the upholstery is pulled tightly over the frame and the corded edge is secured in place on the underside of the frame by deploying staples or hog-rings at numerous points along the edge. In the assembly of chairs and the like having a wooden frame, often the upholstery is stapled to the frame at appropriate locations, and the beaded edge serves to reinforce the upholstery to prevent tearing of the upholstery in the vicinity of the staple and, ultimately, separation of the upholstery from the frame.

This type of application procedure is very costly because it is labor intensive. Considerable time is required for manually pulling the fabric tightly over the frame and then securing it in place with hog-rings or staples along the edge of the fabric. Another problem with this procedure is that the application of hog-rings is fraught with danger. The hog-ring often must first pierce the fabric of the material and then be clamped into position about a frame member through the application of considerable force. Since the hog-rings are formed of metal, workers can be cut and, because the application of force is required, slippage or other problems can cause injury to the worker, or even to the seat. Furthermore, the hog-ring guns often jam, and workers are injured trying to un-jam the guns. Finally, the quality of each upholstered seat is dependent on the skill of the worker. Often, there is no uniformity from seat to seat in the snugness of fit or in the manner of attachment.

It is therefore an object of the present invention to provide an improved method for securing upholstery to an automobile seat or chair.

It is a further object of the present invention to provide apparatus for quickly, accurately and uniformity securing upholstery to an automobile seat or chair.

It is another further object of the present invention to provide apparatus for securing upholstery to an automobile seat which replaces the use of hog-rings.

SUMMARY OF THE INVENTION

The above and other objects are achieved in accordance with the present invention in which a narrow tape or web with a cord is secured to the edges of a piece of upholstery which has been pre-cut for installation on an automobile seat or chair or other like furnishing. The cord is incorporated into the tape or web and can be accessed at selected points therealong. The seat or chair is provided with hooks or other fastening devices at desired locations adjacent to the point where the cord can be accessed. The cord is looped over or attached to these hooks for securing of the upholstery to the frame.

The web can either be elastic or non-elastic. If an elastic web is used, typically a non-elastic cord is embedded into the web, and the length of the cord in the web is greater than the length of the web in its unstretched condition. In this embodiment, however, an elastic cord can also be used. In another embodiment, the web is non-elastic, and the cord likewise can either be elastic or non-elastic. If a non-elastic cord is used, the amount of cord included in the web typically is somewhat greater than the length of the web in its unstretched condition. Either knitted or woven webs may be used, and the cord may be extruded, knitted, braided or knit-braided.

In any of the foregoing embodiments, the amount of cord needed for securing of the upholstery to seat must be previously determined. Also, the locations of the hooks disposed on the seat must be known. A web is then constructed so that, if a non-elastic cord is used, precisely the right amount of extra cord is disposed in the web along the periphery of the upholstery, so that when the cord accessed at each desired point along its length and hooked onto a hook on the seat frame, the upholstery is tightly stretched over the frame in the correct location. If an elastic cord is used, the elasticity must be known, so that when the cord is stretched out of the web to be attached to a hook, at each pre-selected location along the periphery of the upholstery, there is sufficient tension along the entire length of elastic cord that the upholstery is stretched tightly over the frame in its desired location.

In the method of this invention, a web with an incorporated cord is sewn around the perimeter of the upholstery to be attached to a chair or automobile seat. The web is designed so that the cord can be accessed at the desired locations. The web is constructed to contain the amount of cord required for attachment of the web to hooks in the frame at predetermined positions along the lower portion of the frame. The cord is then accessed at locations adjacent the hooks and latched onto the hooks. As a result, the upholstery is stretched tightly over the frame and is positioned in a desired orientation with respect to the seat or chair.

The foregoing invention provides a simple, labor-saving, accurate and repeatable method and apparatus for applying upholstery to an automobile seat or chair.

BRIEF DESCRIPTION OF THE DRAWINGS

The objects, advantages and features of this invention will be more clearly appreciated from the following detailed description when taken in conjunction with the accompanying drawings in which:

FIG. 1 is a bottom perspective view of an automobile seat showing use of the present invention in one embodiment;

FIG. 2 is a bottom perspective view of an automobile seat showing use of the present invention in another embodiment;

DETAILED DESCRIPTION OF THE PREFERRED EMBODIMENTS

Figure 3:
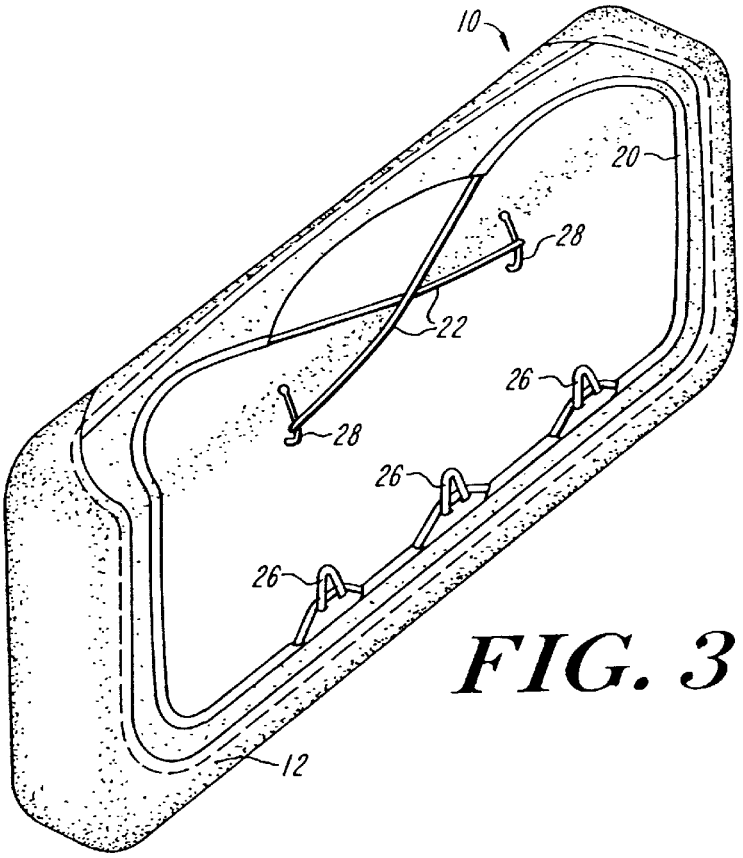
FIG. 3 is a bottom perspective view of an automobile seat showing use of the present invention in yet another embodiment.

With reference now to the drawings, and more particularly to FIGS. 1–3 thereof, a novel method of securing upholstery to a seat, such as an automobile seat, will be described. While seat 10 of FIGS. 1–3 is shown to be an automobile seat for purposes of illustration, it is to be understood that seat 10 could be any type of seat such as a sofa or armchair or the like, which includes a frame and springs and/or cushions onto which upholstery 12 is to be secured. The frame may be wooden/metal or plastic in construction.

Seat 10 is provided with a plurality of hooks 14 or other types of fastening devices on an undersurface 16 thereof. Upholstery 12 has been previously cut to size so that it will fit snugly about seat 10. Web or tape 20 is secured to upholstery 12 about a perimeter 13 thereof on undersurface 16 of seat 10. Web 20 is attached to upholstery 12 along one edge 42, such as by sewing, of the like. Web 20 has been pre-cut and sized to extend more or less continuously around the perimeter 13 of upholstery 12. Web 20 contains within it a cord 22. Cord 22 typically is disposed adjacent an edge 44 of web 20 opposite of edge 42. As can be seen from FIG. 1, upholstery 12 is held in place on seat 10 by extracting cord 22 from web 20 at locations adjacent hooks 14 and manually attaching cord 22 to associated hooks 14. Preferably, although not necessarily, web 20 has been pre-cut and designed to have the exact amount of cord required for a particular application. Thus, an installer need merely pull the cord from web at the web 20 at pre-selected locations and secure the cord to hooks 14, to properly secure upholstery 12 to seat 10 with the desired tension and in the desired location. Alternatively, the installer can select appropriate webs with the length of cord desired from an available selection of webs with different amounts of cord and differing characteristics. No hog-rings or staples or other like fastening devices are required.

FIGS. 1, 2 and 3 show three alternative but acceptable variations for attachment of upholstery 12 to seat 10. In FIG. 1, eight hooks 14 have been provided, three along each longitudinal side and two at each traverse end of seat 10. Hooks 14 each have two legs 15 and are bent inwardly away from web 20, or away from the edges of seat associated therewith to allow easy attachment of cord 12 and to prevent the undesired release of cord 22 after installation. In FIG. 2, only three hooks are provided, one hook 26 and two hooks 28. Hooks 26 and 28 are only disposed along the longitudinal side edges of the seat and no hooks are provided adjacent the transverse ends of the seat. Hook 26 has two legs 27, while each hook 28 has a single leg 31, and an upper portion 29 which is disposed at generally right angles to leg 31. In the embodiment of FIG. 2, cord 22 is extracted from web 20 at five locations. One location is adjacent hook 26, and the cord at this location is latched onto hook 26. Cord 22 is extracted from two other locations, one on either side of hook 26, from which locations cord 22 is secured to upper portions 29 of hooks 28 on the opposite side of the seat. Finally, cord 22 is extracted from web 20 at two locations on a side of the seat adjacent hooks 28, as shown. Cord 22 in these two locations is disposed in a criss-crossing relationship so that the cord extracted from a part of web 20 adjacent one hook 28 is secured to the other hook 28.

In FIG. 3, three hooks 26 are provided along one longitudinal edge of the seat, while two hooks 28 are provided along the other longitudinal edge of the seat. Along one longitudinal edge of seat 10, cord 22 is extracted from web 20 at locations adjacent each hook 26 and is secured to its associated adjacent hook 26 at those locations. Along the other longitudinal edge of seat 10, cord 22 is extracted from web 20 adjacent one hook 28 and stretched in a longitudinal direction along the seat to be attached to the other hook 28 so that the cord 22 is disposed in a criss-crossing pattern, much like that shown in FIG. 2.

In each of these embodiments of FIGS. 1–3, web 20 may either be elastic or non-elastic, and can either be knitted, woven or braided. Moreover, cord 22 may be either elastic or non-elastic and may be either extruded, knitted, braided or knit-braided, such as the type of cord formed by a Lamb knitting machine.

Figure 4:
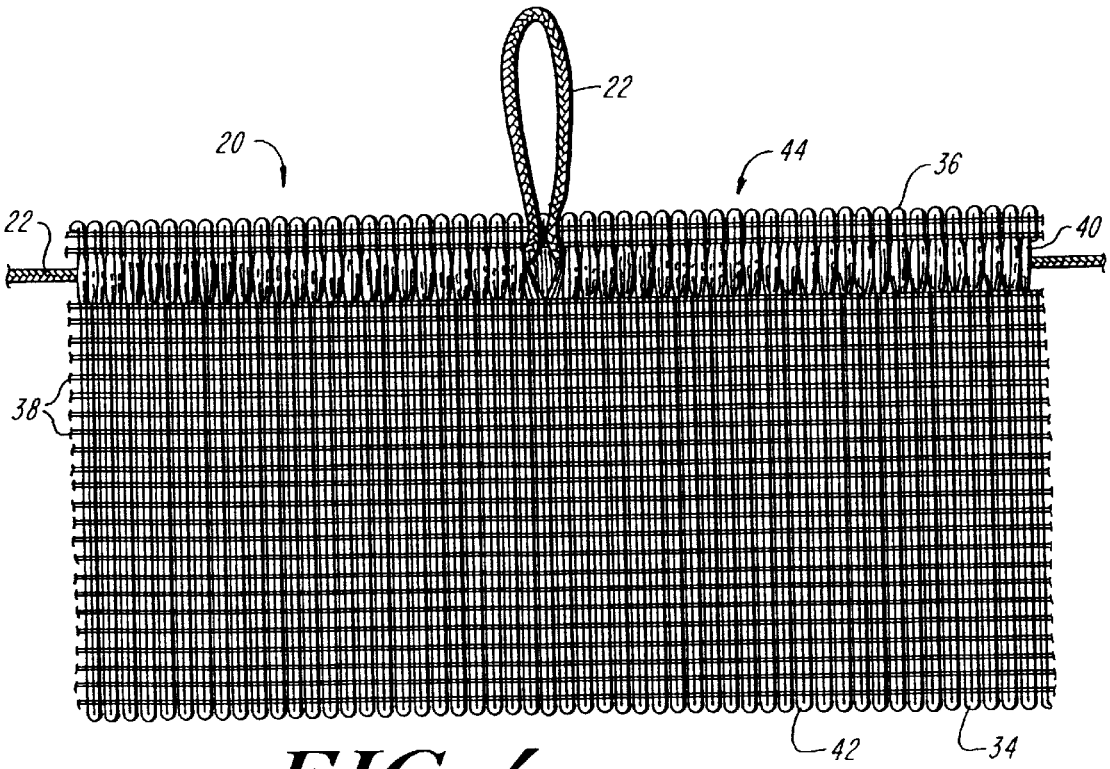
FIG. 4 is a plan view of a typical knitted web of this invention used to secure upholstery to seats in the manner shown in FIGS. 1–3.

An exemplary web 20 is shown in FIG. 4. Web 20 is knitted and includes a front filling yarn 34, a back filling yarn 36 and warp knitting yarns 38. Cord 22 is inserted during the knitting process and is laid into the structure of the fabric. A space is provided for cord 22 by eliminating one or more warp knitting yarns 38 adjacent one edge of web 20, as shown, and floating the front and back filling yarns 34 and 36 over this space, to provide a channel 40 between front and back filling yarns 34 and 36 into which cord 32 is laid. In the final product, cord 22 is captured between the front and back filling yarns 34 and 36. Typically, three yarns 38 are elemental and the needles associated therewith also are removed to allow proper feeding of the cord into web 20. This channel 40 can be positioned at any place across the width of web 20, but is typically disposed adjacent an edge 44 opposite edge 42.

In the embodiment of FIG. 4, cord 22 may be either elastic or non-elastic. If cord 22 is elastic, typically sufficient cord is laid into web 20 that cord 22 in its unstretched condition is approximately the same length as is the finished web 20 in its unstretched condition.

However, if cord 22 is non-elastic, an extra length of cord typically is included within web 20, so that cord 22 is greater in length, when removed from web 20, than web 20 in its unstretched condition. Enough extra cord must be available in web 20 so that cord 22 can be pulled out and secured to hooks 14, 26 or 28. The precise amount of extra cord depends on the particular application, the size of seat 10, location of the various hooks, and how the cord is to be secured to the hooks, i.e. whether it is to be secured as shown in FIGS. 1, 2 or 3. The required amount of extra cord, typically, is determined by trial and error.

Figure 5:
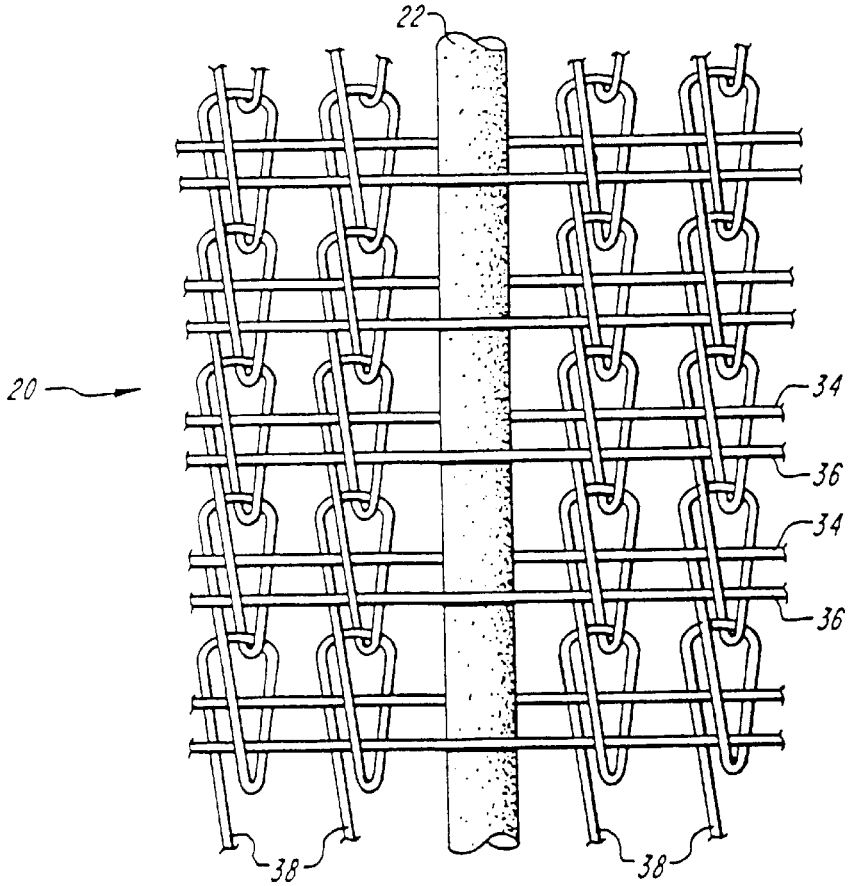
FIG. 5 is a schematic diagram of a non-elastic embodiment of the web of FIG. 4.
Figure 6:
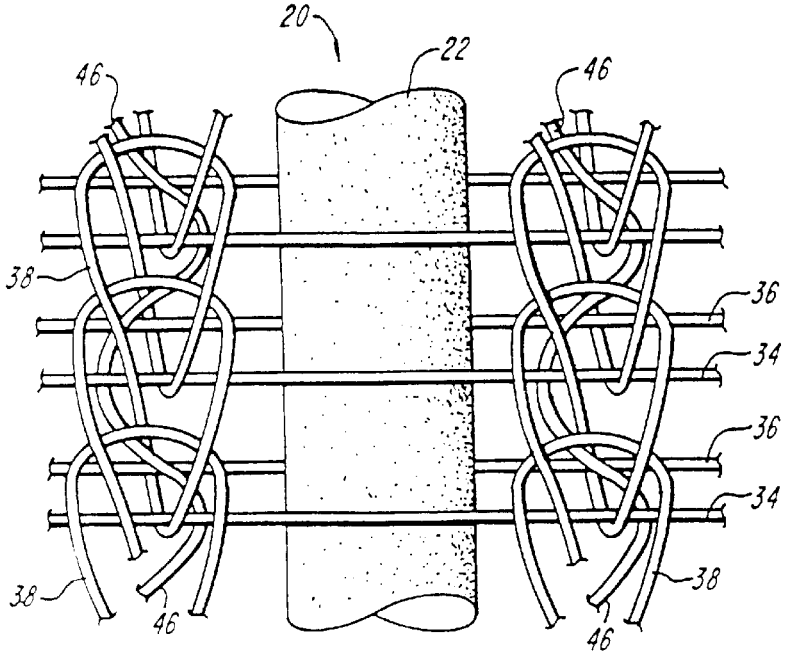
FIG. 6 is a schematic diagram of an elastic embodiment of the web of FIG. 4.
Figure 7:
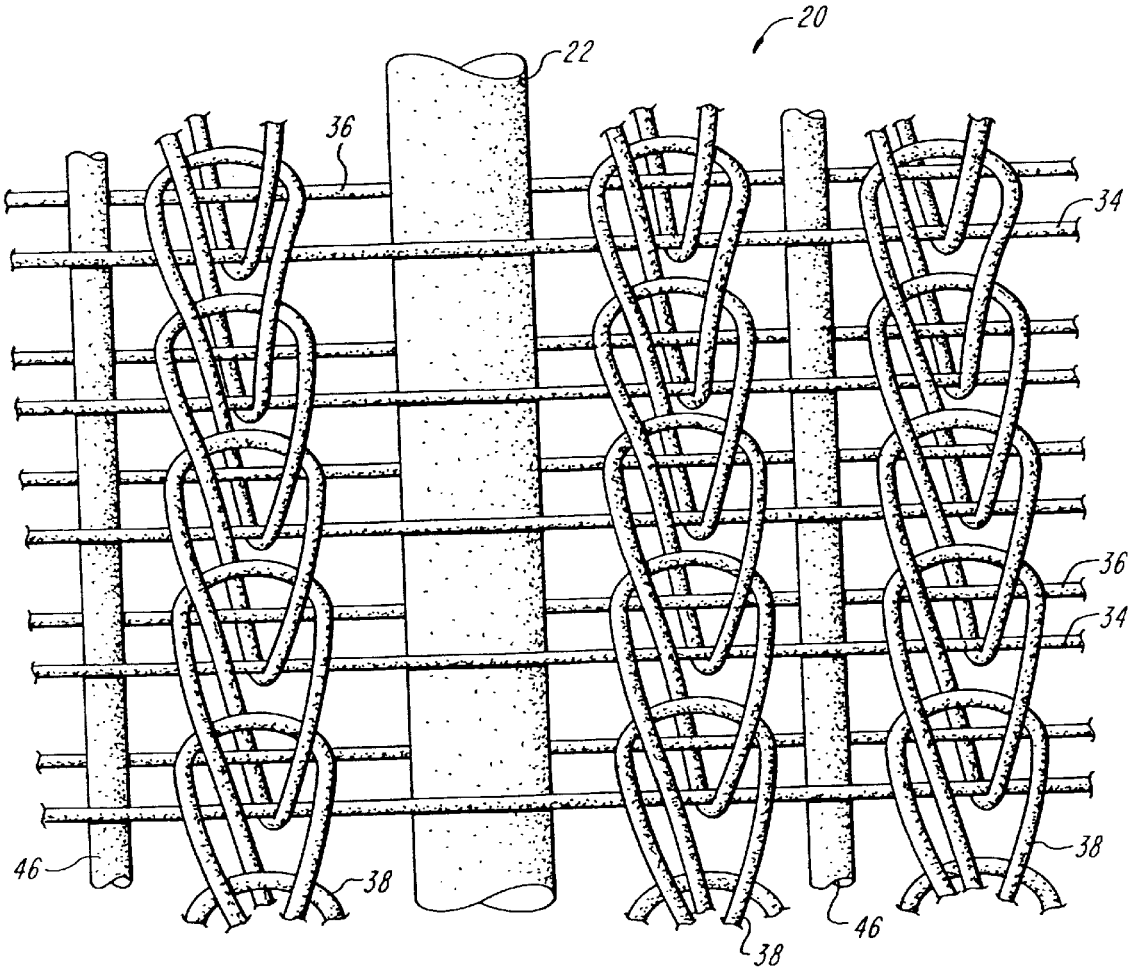
FIG. 7 is a schematic diagram of another elastic embodiment of the web of FIG. 4.

FIGS. 5–7 illustrate three different embodiments of the knitted web of FIG. 4. Any one of these embodiments of FIGS. 5–7 may be used, depending upon the particular application. FIG. 5 is illustrative of a knitted, non-elastic web incorporating cord 22 therein. Like numbers will be used for like elements, where applicable. FIG. 5 represents a technical back of the knitted web 20. As can be seen, cord 22 is captured between back filling yarns 36 and front filling yarns 34. Web 20 is a warp knitted web, and filling yarns 34 and 36 pass alternately back and forth widthwise across web 20. Warp knitting yarns 38 extend longitudinally or warpwise along the band in the form of a chain stitch, as shown in FIG. 5, and pass alternately over and under adjacent pairs of front and back filling yarns 34 and 36.

In the embodiment of FIG. 5, cord 22 may be either elastic or non-elastic depending upon the particular application. If cord 22 is not elastic, it may be desired to have an extra length of cord incorporated into the web. This extra length may be incorporated in one of many ways. In the first way, the loops in warp yarns 38 may be made larger. Another way of incorporating extra cord is to use textured, polyester yarn which has some give or stretch. A third way, which could be used in conjunction with either larger loops or textured yarn, or both, is to tension the warp yarns during the knitting process, and then to relax the tension after formation of the web to allow the web to relax and gather up or bunch the cord longitudinally to produce an extra length of cord in the band. The amount of extra cord introduced is proportional to the amount of tension on the band. Finally, the amount of cord introduced into the web can also be controlled by changing the tension on the cord as it is fed into the web during the knitting process. Greater tension on the cord produces a smaller amount of cord in the web. The extra amount of cord introduced into the band as a result of these processes would be relatively small, so that cord 22 is typically less than 10% longer than a given length segment of web 20 in an unstretched condition when cord 22 has been removed from that segment of the web.

Another embodiment of the web of FIG. 4 is illustrated in FIG. 6. FIG. 6 represents a technical face of web 20. Like numbers are used for like elements where applicable. This embodiment includes elastic yarns 46 which have been laid into the structure of the band. Elastic yarns 46 extend generally in a longitudinal or warpwise direction along and parallel to cord 22. Elastic yarns 46 are held in place by warp yarns 38 which are formed into a chain stitch as previously described with respect to FIG. 5. Front filling yarn 34 and back filling yarn 36 pass back and forth along the respective base and back surfaces of web 20, as previously described and are held in place by warp yarns 38 in a known manner. Front and back filling yarns 34 and 36 pass on opposite sides of cord 22 to hold cord 22 in position. In the embodiment of FIG. 6, web 20 has a significant degree of elasticity. During the knitting process, elastic yarns 46 are under tension, as are warp yarns 38. The yarns are tensioned by the use of a set of take up rollers (not shown) which draw the elastic yarns 46 and warp yarns 38 through the knitting zone, in a conventional manner. This tension can be adjusted in a number of ways, including increasing the speed differential between the take up roller and the rollers feeding the yarns into the knitting machine, by increasing the drag on the yarns 38 and 46 by passing them over or around stationary rollers or the like or by other well known techniques. The greater the amount of tension on yarns 38 and 46, the greater is the stretch in the web during the knitting process, and therefore the greater is the amount the web relaxes after knitting as it passes over the take-up rollers. The greater the amount of stretch on yarns 38 and 46, the greater is the amount of extra cord 22 incorporated into the finished web. By extra cord, it is meant that should the cord be removed from a given length of web 20, the amount of cord in this given length is greater than is the length of the web in its longitudinal direction in an unstretched condition. The greater the amount of cord incorporated into the band, the greater is the amount of cord available to be pulled out of the band at any point along its length and secured to a suitable hook, as described.

A third embodiment of the band of FIG. 4 is illustrated in FIG. 7. FIG. 7 contains the same elements as FIG. 6, and like numbers are used for like elements, where applicable. FIG. 7 again represents a technical face of web 20. In FIG. 7, web 20 includes cord 22, warp yarns 38, and elastic yarns 46, as well as front filling yarn 34 and back filling yarn 36. As before, front and back filling yarns 34 and 36 pass back and forth transversely across the respective face and back of web 20. Cord 22 passes between front and back filling yarns 34 and 36. Each warp yarn 38 extends in a longitudinal or warpwise direction forming a chain stitch with itself as it passes over and under filling yarns 34 and 36 in the pattern shown. This time, instead of being interlooped with warp yarns 38, elastic yarns 46 are disposed between warp yarns 38 and are unattached thereto. Elastic yarns 46 are held in place only by front and back filling threads 34 and 36 between which elastic yarns 46 pass, in much the same manner as cord 22. In this embodiment, elastic yarns 46 are permitted to move with respect to front and back filling threads 34 and 36 and with respect to warp yarns 38. Therefore, while elastic yarns 46 provide some elasticity to web 20, they do not provide the same level of elasticity as in the embodiment of FIG. 6. In the embodiment of FIG. 7 an extra length of cord 22 can be incorporated into web 20 by tensioning elastic yarns 46 and warp yarns 38 during the knitting process, as previously described with respect to FIG. 6. However, since the elasticity of the web in FIG. 7 is less than that of FIG. 6, less additional cord will be incorporated into the web of FIG. 7 than into the web of FIG. 6. The embodiment of FIG. 7 is most suitable for applications where a small amount of extra cord is desired to be incorporated into web 20.

In each of the embodiments of FIGS. 4–7, web 20 may be knitted on any conventional rashel crochet or rashel knitting machine, and each of these embodiments is what is commonly known as a warp knit. The precise set-up on the machine is incidental to this invention, and can be determined by one of ordinary skill in the art. Typically, one bar is associated with each of the front and back filling yarns 34 and 36. Another bar is associated with warp yarns 38, while elastic yarns 46 are associated with another bar. Typically, one needle is associated with each of front and back filling threads 34 and 36, and the needle passes transversely across the entire web from side to side. The needles associated with front and back filling yarns 34 and 36 can move in opposite directions, or in the same direction, as desired, depending upon the type of pattern or selvage necessitated by the application. However, multiple needles can be used for the front and back filling yarns 34 and 36, with each needle passing only part way across the transverse width of web 20.

In the embodiment of FIGS. 4–7, the cord 22 may be pulled out of the web at any location along its length, simply by reaching between the front or back filling yarns 34, 36, grasping the cord and pulling it out between the filling yarns. Typically a hook or the like may be used. In this way, the installer can pull the cord out at any desired location, or the cord can be extracted at the factory prior to installation.

Figure 8:
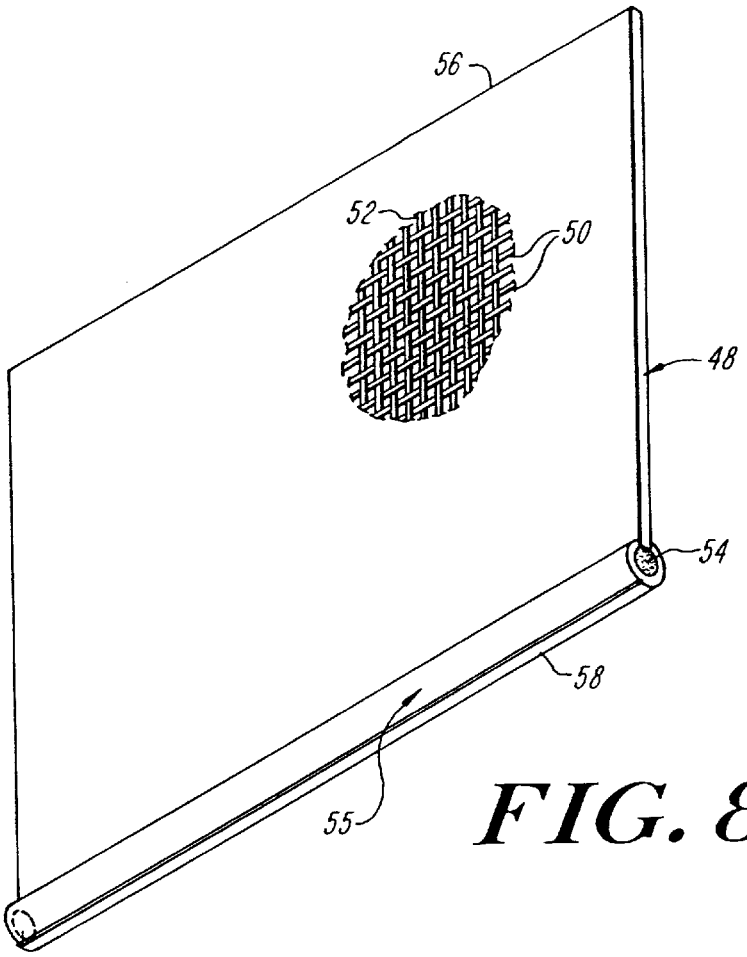
FIG. 8 is a partially cut-away perspective view illustrating a woven embodiment of the web of this invention.
Figure 10:
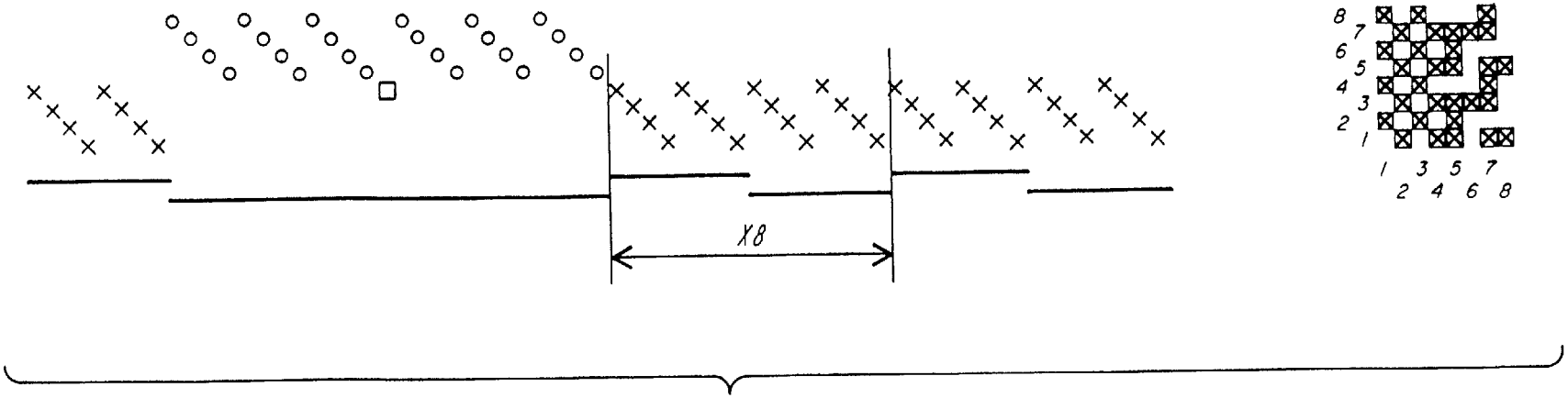
FIG. 10 is a weaving diagram for the web of FIG. 9;.

Another embodiment of this invention is shown in FIGS. 8 and 10. This embodiment discloses a woven web 48, including warp yarns 50 and weft yarns 52 and 60 and cord 54. In this embodiment, two sets of weft yarns 52 and 60 interlace with warp yarns 50 in a known manner. In the vicinity of cord 54, one weft yarn 52 yarns passes over the cord 54 while the other weft yarn 60 passes below cord 54 to form a tunnel 55 through which the cord 54 can slide. As in the embodiment of FIG. 4, cord 54 is disposed along one edge 58 opposite of an edge 56 which is secured to upholstery 12.

FIG. 10 illustrates an exemplary manner in which web 48 may be woven, although it is understood that variations are permitted within the scope of this invention. In FIG. 10, the X's and O's represent the warp yarns, and the X's come off one beam while the O's come off another beam. The square represents the heddle and position for the cord.

Figure 9:
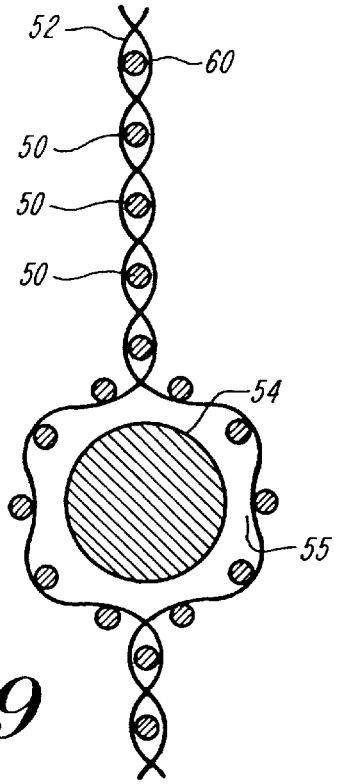
FIG. 9 is a cross-sectional, schematic view of the web of FIG. 8.

In the embodiment of FIGS. 8–10, cord 54 can be accessed in one of many different ways. As with the web of FIGS. 4–7, the cord can be extracted by reaching between the weft yarns 52 or 60 with a hook or needle or the like and grasping the cord to pull it out. Alternatively, a button hole can be formed over the cords 54, or a slit can be woven into the fabric adjacent cord 54. Also, slots can be cut into yarns 50 and 52 or 60 covering cord 54. Typically, a heated knife or razor blade or other like implement is used to cut a plurality of slots (not shown) through which the cord 54 may be accessed. The slots could also be sonically cut. The hot knife or sonic cutting melts the surrounding ends of the yarns and seals the edges of the slot to prevent unravelling of the fabric.

In the embodiment of FIGS. 8–10, warp yarns 50 may be either elastic or nonelastic. If warp yarns 50 are elastic, web 48 is woven under tension, so that yarns 50 are tensioned while being interlaced with weft yarns 52 and 60. This embodiment would be preferred where it is desired to have an extra length of cord incorporated into the web 48. Where no extra length of cord is desired, neither warp yarns 50 nor weft yarns 52 and 54 need be elastic.

Figure 11:
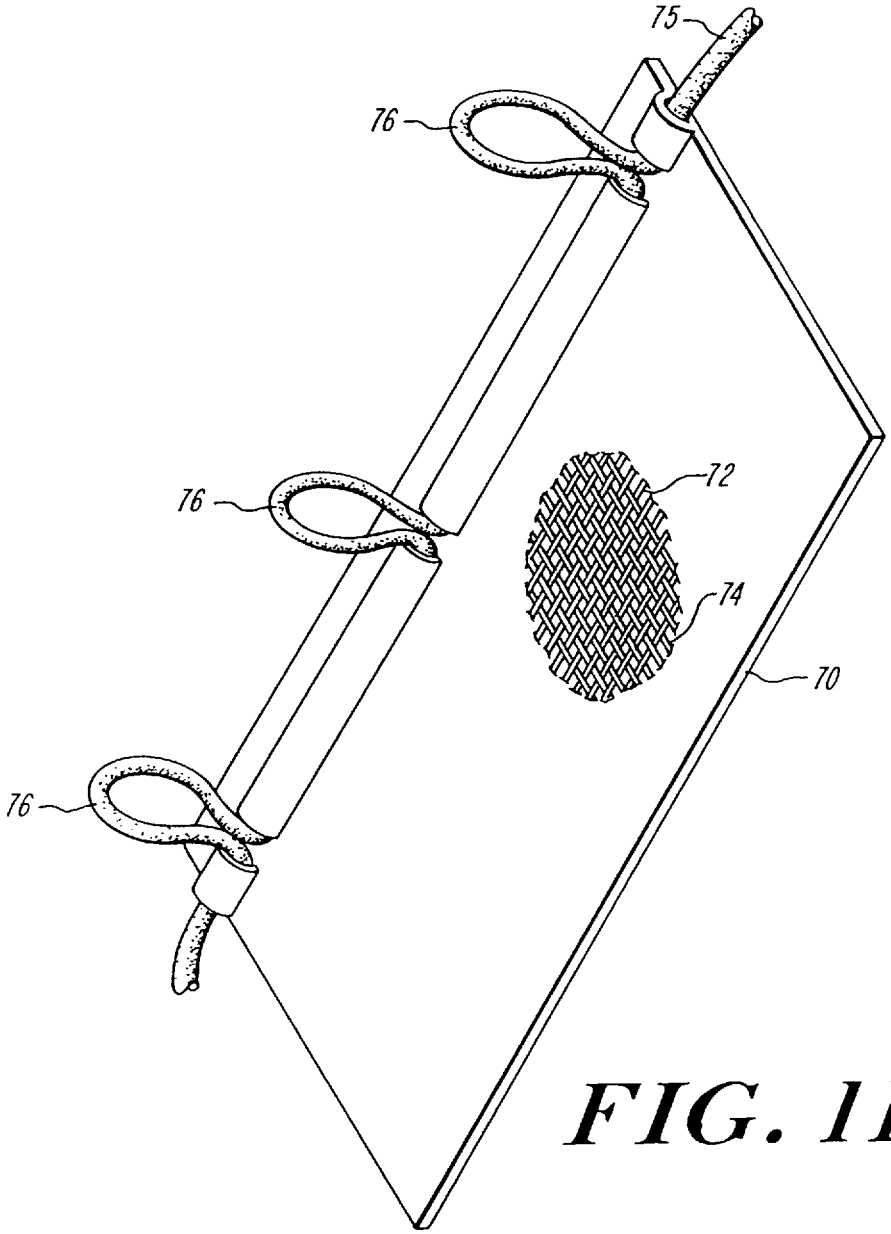
FIG. 11 is a partially cut away perspective view of another embodiment of the web of FIG. 8.

Another woven embodiment of this invention is shown in FIG. 11. Web 70 of FIG. 11 is woven, like web 48 of FIGS. 8–10, and includes warp yarns 72, weft yarns 74, and cord 75. During the weaving process, at locations in the longitudinal or warp direction where it is desired to have the cord protrude form web 70, cord 75 is lifted out of web 70 by a hook on its associated harness as the weaving process continues. Weft yarns 74 continue to be interwoven with warp yarns 72 below cord 75. Cord 75 is effectively allowed to float as the fabric is being formed. Cord 75 can be allowed to float for one or two or more picks, or passes of weft yarns 73 or 74. Cord 75 can be lifted to almost any height above web 70. In this way, external loops 76 of cord 75 are already formed in the finished web. The amount of extra cord in web 70 may be controlled by the size of loops 76 which in turn is controlled by the distance cord 75 is raised above web 70 during the weaving process and by the number of picks during which cord 75 is floated.

Figure 12:
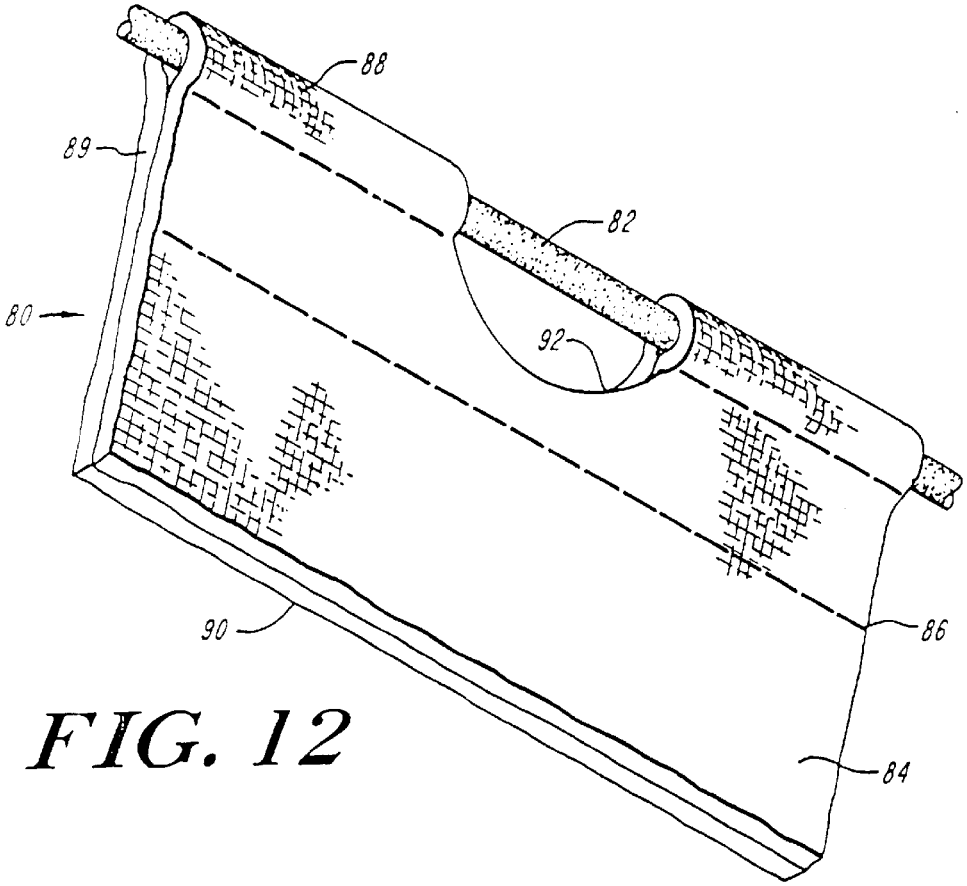
FIG. 12 is a top, perspective view of another embodiment of the web of this invention.

FIG. 12 illustrates another embodiment of the present invention. In FIG. 12, web 80 includes a cord 82 and a fabric 84. Web 80 differs from webs described with respect to previous embodiments in that cord 82 is not knitted or woven into the fabric of the web. Rather, web 80 comprises a layer of fabric which is folded over onto itself and stitched together by stitch 86 to form a channel 89 between stitch 86 and fold 88. During the assembly process, cord 82 is inserted into channel 89. Web 80 is secured to upholstery along edge 90. Fabric 84 made be either woven or knitted, and cord 82 may be either knitted, braided or knit-braided. During or prior to formation of web 80, a notch 92 is cut into fabric 84 to allow access to the cord within channel 89. Notch 92 may be either stamped into fabric 84 in the form of a circle prior to assembly or notch 92 may be cut after assembly using any one of a number of well-known techniques.

Cord 82 may be either elastic or nonelastic. If cord 82 is elastic, typically little or no extra cord is incorporated into web 80. If cord 82 is nonelastic, it may be desired to incorporate an extra length of cord within channel 89. This extra length may be introduced in any one of a number of ways. In one embodiment, cord 82 may be laid into channel 89 in a zig-zag configuration, or the like, during the folding and stitching assembly of web 80. In another embodiment, fabric 84 is elastic in the longitudinal direction and fabric 84 is tensioned in a longitudinal direction during the assembly and stitching process. If this technique is used, the tension is released from fabric 84 after assembly causing cord 82 to gather or bunch within channel 89. As with previous embodiments, the amount of extra cord introduced into channel 89 may be controlled by the amount of tension on fabric 84. The greater fabric 84 is stretched or tensioned during assembly, the more cord that is introduced into channel 89 after release of the tension. Similarly, the amount of cord introduced also can be controlled by the amount of tension on the cord and whether additional cord is laid into the channel 89 in a zig-zag or other pattern during the assembly process in combination with the applied tension on fabric 84. These techniques allow relatively precise control of the amount of cord introduced into web 80.

Figure 13:
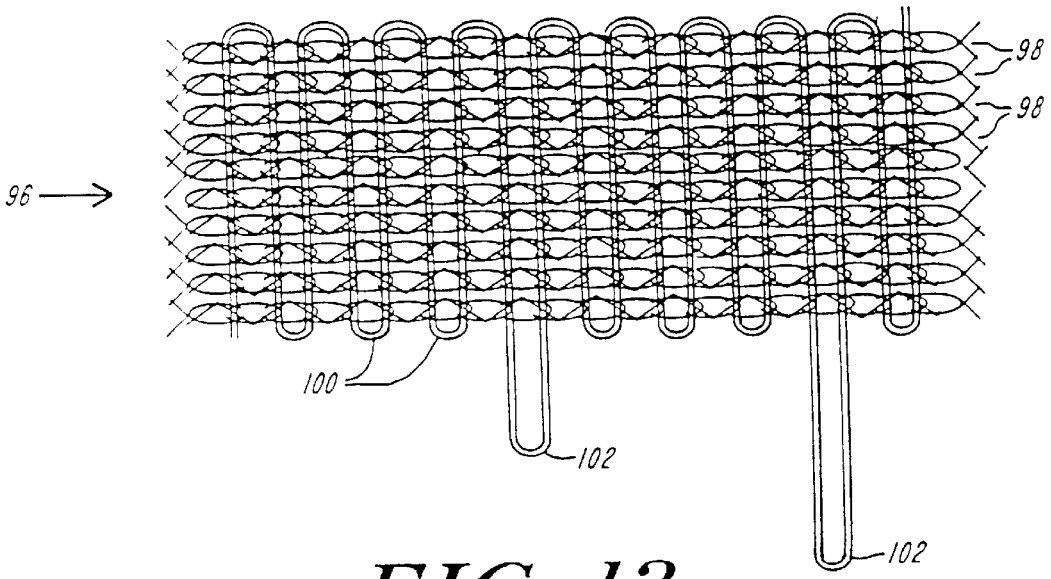
FIG. 13 is a top, schematic view of yet another embodiment of the web of this invention.

FIG. 13 illustrates a further embodiment of the web of this invention which may be used for securing upholstery to a seat. Web 96 of FIG. 13 typically is a warp knitted web produced on a crochet knitting machine. Web 96 includes warp knitting yarns 98 and filling yarns 100. Yarns 98 and 100 are knitted together in much the same way as the filling and warp knitting yarns of FIG. 5. However, in this embodiment, only a single filling yarn is utilized. Filling yarn 100 is a much heavier yarn and is of about the same size, strength and structure as cord 22 of the embodiment of FIG. 5. During the knitting process, the knitting needle associated with filling yarn 100 is programmed to traverse beyond the outermost warp yarn 98 to produce loops 102 which are unconnected to warp yarns 98. It is these loops 102 that are secured to hooks or other fastening devices on the frame of the seat and which serve the function of the pull cord 22 in previous embodiments, such as those of FIGS. 4 thru 7. In the embodiment of FIG. 13, yarns 98 and 100 are typically nonelastic. Warp yarns 98 must be of a type to provide the desired level of strength to web 96. If necessary, additional warp and filling yarns can be added to the web of 96 to increase the strength and rigidity of the web in a manner well known to those skilled in the art.

An alternative embodiment of the hook or fastening device utilized in conjunction with the web and upholstery of this invention will now be described with particular reference to FIGS. 14 and 15. Fastening device 110 includes resilient clips 112 and 114 disposed on opposed edges of one surface thereof, and a slot 118 to which access is provided by a mouth 120. Mouth 120 has a wide opening and narrows as it approaches slot 118. Device 110 also includes resilient, raised prongs 122 which surround slot 118 and typically project from a surface opposite of the surface on which clips 112 and 114 are disposed.

Figure 14:
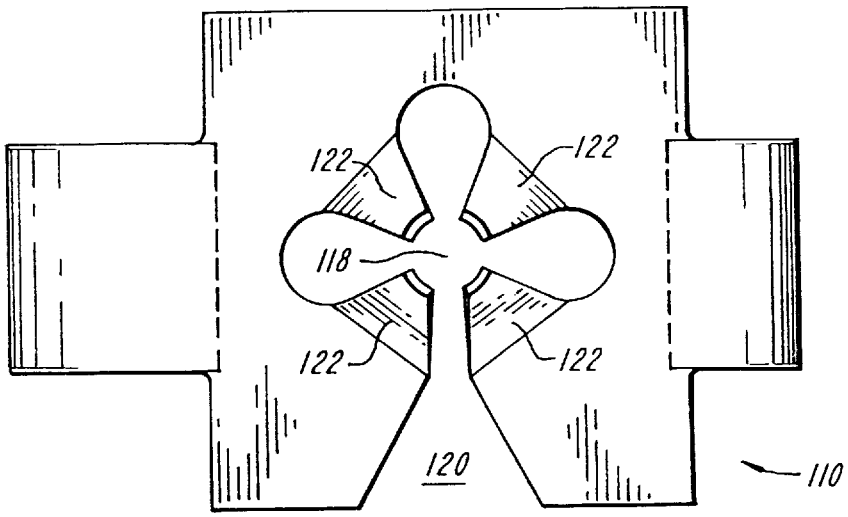
FIG. 14 is a top, plan view of a fastening device for use with the web of this invention.
Figure 15:
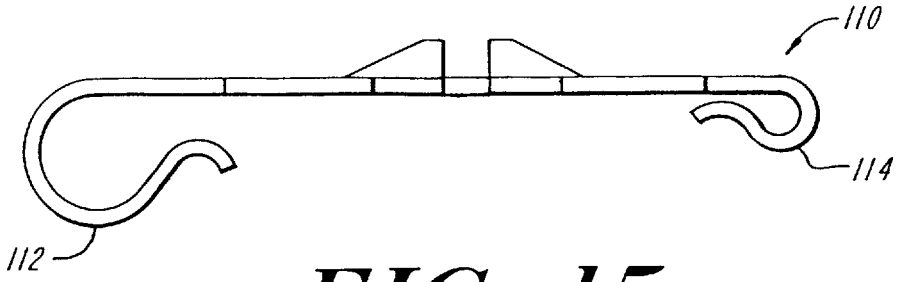
FIG. 15 is a side, plan view of the fastening device of FIG. 14.

Device 110 of FIGS. 14 and 15 may be used to grasp cord 22 in one of two different ways. In one method, clip 114 is snapped over cord 22 and clip 112 is snapped over a portion of the frame of seat 10. The installer may grasp device 110 and pull it tightly until the desired tension has been applied to cord 22, and thereafter clip 112 may be snapped over an appropriate portion of the frame or to a hook 14 disposed on the frame in a desired location. In the second method, cord 22 may be withdrawn from web 20 and pulled through slot 118 by way of mouth 120 and retained in position by prongs 122. Device 110 may then be secured to the frame of seat 10 in a manner well known to those skilled in the art. For example, device 110 could be stapled to the frame. Alternatively, cord 22 could be pulled through a hook 14 or a slot in the frame of seat 10, and thereafter device 110 would be applied to cord 22 after tensioning of cord 22. The tension on cord 22 would draw device 110 into a butting relationship with hook 14 or the frame to hold device 110 in position with cord 22 attached.

In each of the foregoing embodiments, both web 20 and cord 22 would be elastic when elongation is a primary consideration. Some manufacturers of automobile seats and the like require a product that has memory and will adjust itself to different elongation factors, such as when stress or weight is applied to the seat. Once relieved of the weight, the web would spring back to its original shape. An elastic web 20 with a nonelastic cord 22 would be often used when elongation is a concern, but when stabilization is required once the cord is attached to the seat. A nonelastic web 20 with an elastic cord 22 would be used when upholstery must be stabilized, but when the location of the hooks are not exactly known, and the installer must have some flexibility. A nonelastic web 20 with nonelastic cord is often used when elongation must be kept to a minimum for specific length requirements, and the web 20 must end at a very specific point on the upholstery during installation. In all cases, the inherent elongation of web 20 must be sufficient for the amount of stress applied to the seat and upholstery fabric during use.

The stretch and strength of the cord can be controlled by selection of yarns and by the method of manufacture. For example, a loosely knit or braided cord is less strong but more stretchable than a tightly knit or braided cord. Texturized polyester also provides more stretch to the cord. The stretch also can be increased by the use of elastic yarns and by formation under tension, as is well-known in the art.

In some applications, it is desired to use one or more of the foregoing combinations together on the same piece of upholstery at different points along the perimeter of the upholstery. Certain portions of the seat may have different performance requirements than other portions, or some portions may require an additional length of cord for attachment to a hook or other like item. Thus, the desired combination can be selected and applied to the upholstery at the desired location either prior to installation, or at the installation site. If done at the installation site, the installer can select the desired length and performance characteristics of the products desired, and install them as needed to produce the attachment required.

In some embodiments it may desirable to provide more than one cord 22 in web 20. In such an embodiment, all cords would be parallel to one another. Each cord would be incorporated into the web in precisely the same manner as has been previously described for webs with a single cord. Such structures would be useful where it is necessary to attach a web to a frame of a seat in a number of different locations or where a greater length of cord is required than can be provided by a single cord incorporated in the web.

In most applications of this invention, the web 20 would be designed and manufactured for a particular application and a particular type of upholstery. Precut lengths of web with precisely predetermined amounts of cord therein would be provided to the installer along with upholstery. Markings would be provided on the upholstery and on the web segments indicating where they are to be attached to one another. In this manner, when the installer applies the upholstery to the seat, precisely the required amount of cord is available for attachment and the cord can be accessed or is already pulled out of the web at precisely the right locations for attachment to the hooks or other attachment devices on the seat. The hooks or other attachment devices would have already been installed in the proper locations for mating with the web being used.

The foregoing invention provides a quick, simple and less expensive and less dangerous method of attachment of upholstery to a seat, automobile seat or item of furnishing. Moreover, this design accommodates a certain amount of stress and strain in the item to which the upholstery is attached without release of the fastening. Another advantage of this invention is that it allows standardization in the assembly of automobile seats or other seats and the like. Each seat would have the same amount of tension on the upholstery, and would have the tension distributed around the upholstery in the desired manner. The tension, fit and attachment of the upholstery can be precisely predesigned and implemented on each seat in contrast to certain prior art techniques in which there was a great deal of variability from seat to seat. Finally, should it be desired to replace the upholstery, it can be done expeditiously with little or no damage to the frame.

In view of the above description, it is likely that modifications and improvements will occur to those skilled in the art which are within the scope of this invention. The above description is intended to be exemplary only, the scope of the invention being defined by the following claims and their equivalents.

What is claimed is:

1. A fastening arrangement for securing fabric to a seat or a component thereof, the fabric being configured to conform to a size and shape of the seat or the component and having an outer perimeter, the seat or seat component having a plurality of sides and an outer edge extending around the plurality of sides, said arrangement comprising:

a web disposed about the perimeter of the fabric, said web having a longitudinal direction extending generally parallel to the perimeter of the fabric and having a length measured in the longitudinal direction, said web having first and second ends;

a continuous cord disposed within said web and extending along the entire length of said web in said longitudinal direction, said cord having two ends, one end extending from said web at said first end and the other end of said cord extending from said web at said second end of said web;

a plurality of openings disposed in said web adjacent said cord between said first and said second ends of said web; and at least one device disposed on the seat or the seat component along each one of the plurality of sides of the seat or seat component adjacent said outer edge for attachment of said cord to the seat or seat component at said openings in said web, each of said devices being associated with at least one opening in said web and all of said devices having at least a portion thereof extending away from the adjacent outer edge of the seat or seat component.

2. The arrangement as recited in claim 1 wherein said web is of a woven construction.

3. The arrangement as recited in claim 2, wherein said web comprises:

a plurality of first weft yarns passing over one side of said cord;

a plurality of second weft yarns passing over a second side of said cord; and a plurality of warp yarns, said warp yarns extending generally parallel to said cord, some of said warp yarns being disposed on said one side of said cord and others of said warp yarns being disposed on said second side of said cord.

4. The arrangement as recited in claim 1 wherein said web comprises:

a first set of weft yarns passing over said cord on one side of said cord;

a second set of weft yarns passing over said cord on an opposite side of said cord from said first set of weft yarns to capture said cord between said first and second sets of weft yarns; and at least one gap of at least two picks in width disposed between adjacent ones of said second set of weft yarns to permit access to said cord.

5. A method for securing fabric to a seat or a component thereof, the seat or seat component having a plurality of sides and an outer edge extending around the plurality of sides, said method comprising the steps of:

cutting the fabric to a desired size and shape, the fabric having a perimeter which is to be secured to the seat or seat component;

providing a web about the perimeter of the fabric, the web having a length and first and second ends;

incorporating a continuous cord into the web along the entire length of the web so that ends of the cord extend from the web at the first and second ends of the web;

providing at least one fastening device on the seat or seat component along each one of the plurality of sides of the seat or seat component adjacent the outer edge, each fastening device being associated with at least one opening in the web and all of said fastening devices having at least a portion thereof extending away from the adjacent outer edge of the seat or seat component; and attaching the cord to the extending-away portions of associated ones of the fastening devices at the openings such that the cord passes around each of said devices on a side thereof opposite the adjacent outer edge of the seat or seat component.

6. A fastening arrangement for securing fabric to a seat or a component thereof, the fabric being configured to conform to a size and shape of the seat or the component and having an outer perimeter, the seat or seat component having a plurality of sides and an outer edge extending around the plurality of sides, said arrangement comprising:

a web disposed about the perimeter of the fabric, said web having a longitudinal direction extending generally parallel to the perimeter of the fabric and having a length measured in the longitudinal direction, said web having first and second ends;

a continuous cord disposed within said web and extending along the entire length of said web in said longitudinal direction, said cord having two ends, one end extending from said web at said first end and the other end of said cord extending from said web at said second end of said web;

a plurality of openings disposed in said web adjacent said cord between said first and said second ends of said web; and at least one device disposed on the seat or the seat component along at least two of the sides of the seat or seat component adjacent said outer edge for attachment of said cord to the seat or seat component at said openings in said web, each of said devices being associated with at least one opening in said web and all of said devices having at least a portion thereof extending away from the adjacent outer edge of the seat or seat component.

7. A method for securing fabric to a seat or a component thereof, the seat or seat component having a plurality of sides and an outer edge extending around the plurality of sides, said method comprising the steps of:

cutting the fabric to a desired size and shape, the fabric having a perimeter which is to be secured to the seat or seat component;

providing a web about the perimeter of the fabric, the web having a length and first and second ends;

incorporating a continuous cord into the web along the entire length of the web so that ends of the cord extend from the web at the first and second ends of the web;

forming a plurality of openings in the web between the first and second ends of the web;

providing at least one fastening device on the seat or seat component along at least two of said sides of the seat or seat component adjacent the outer edge, each fastening device being associated with at least one opening in the web, and all of said fastening devices having at least a portion thereof extending away from the adjacent outer edge of the seat or seat component; and attaching the cord to the extending-away portions of associated ones of the fastening devices at the openings such that the cord passes around each of the devices on a side thereof opposite the outer edge of the seat or seat component.

* * * * *